US005440847A

United States Patent [19]

Butler

[11] Patent Number: 5,440,847

[45] Date of Patent: Aug. 15, 1995

[54] MOLDED EXTERIOR DECORATIVE UNIT FOR BUILDINGS

[76] Inventor: Sandra L. Butler, 26 Horseshoe Dr., Roscoe, Pa. 15477

[21] Appl. No.: 132,756

[22] Filed: Oct. 6, 1993

Related U.S. Application Data

[63] Continuation-in-part of Ser. No. 925,958, Aug. 5, 1992.

[51] Int. Cl.[6] ..... E04C 1/00; B44F 9/00

[52] U.S. Cl. ..... 52/311.1; 52/309.8; 52/204.1; 52/208; 52/85; 52/211; D25/52; D25/137; D25/145

[58] Field of Search ..... 156/71; 52/311.1, 309.8, 52/204.2, 204.53, 204.1, 208, 825, 716, 395, 211, 287, 288; D25/52, 121, 136, 137, 145, 149

[56] References Cited

U.S. PATENT DOCUMENTS

| | | |
|---|---|---|
| 52,889 | 1/1919 | Holstein . |
| 147,206 | 2/1874 | Warren . |
| 847,505 | 3/1907 | Ostrander . |
| 2,001,162 | 5/1935 | Strauss . |
| 3,140,517 | 7/1964 | Richter . |
| 3,473,278 | 10/1969 | Gossen . |
| 4,010,578 | 3/1977 | Logsdon . |
| 4,233,780 | 11/1980 | Royce et al. . |
| 4,538,380 | 9/1985 | Colliander . |
| 4,563,846 | 1/1986 | Webb . |
| 4,601,144 | 7/1986 | Tinti . |
| 4,619,093 | 10/1986 | Gandillon . |
| 4,898,760 | 2/1990 | Halberstadt et al. . |
| 4,949,521 | 8/1990 | Riegelman et al. . |
| 4,989,384 | 2/1991 | Kinghorn et al. . |
| 5,123,211 | 6/1992 | Schlicht et al. . |

*Primary Examiner*—Carl D. Friedman
*Assistant Examiner*—Wynn E. Wood
*Attorney, Agent, or Firm*—Armstrong, Westerman, Hattori, McLeland & Naughton

[57] ABSTRACT

A molded exterior decorative unit for securement to a structural facing comprises a molded unit with front and back surfaces and side edges. The front surface has decorative features, while a channel is molded in the back surface into which a compressible, expandable, flexible sealing member is partially secured. Preferably, a groove is formed in the floor of the channel so as to provide a labyrinth path for air or moisture. Upon securement of the molded decorative unit to a facing, the compressible, expandable, flexible sealing member forms a seal adjacent the periphery of the molded unit. In one embodiment, weep holes or slots are provided at the back adjacent a bottom surface of the molded exterior decorative unit. In another embodiment, where the unit is adapted for securement in a recess in the structural facing, the channel is formed in the side edge of the molded unit, and the compressible, expandable, flexible sealing member forms a seal between the side edge and a surrounding wall forming the recess.

25 Claims, 4 Drawing Sheets

MOLDED EXTERIOR DECORATIVE UNIT FOR BUILDINGS

CROSS REFERENCE TO RELATED APPLICATION

This application is a continuation-in-part of application Ser. No. 925,958, filed Aug. 5, 1992.

FIELD OF THE INVENTION

The present invention relates to molded decorative units, such as molded trim, that are applied to the exterior facing of buildings, such as residential housing.

BACKGROUND OF THE INVENTION

In the construction or remodeling of buildings, such as residential houses, molding or trim units are often used to add decorative features to the building. A particularly cost efficient and long lasting type of decorative unit is one that is molded from a foamed thermoplastic material, such as a high density polyurethane. Such polyurethane decorative units may be designed to simulate wood features on the building and can be molded as interchangeable or specially designed features. The exterior decorative units, such as louvers, pediments, door crossheads and mantels, shutters, medallions, or molding and trim are typically secured to the facing, such as brickwork or siding by the use of nails, with or without a construction adhesive.

While an exterior polyurethane molded decorative unit is durable and can decorate a house for an extended period of time, because it is usually secured to an uneven surface over its extent, problems can arise where a sealant is not provided in gaps between the decorative unit and the house facing. With the existence of such gaps, water and resultant ice, or snow, dirt, insects, and other contaminants have entry into the area between the rear of the decorative feature and the house facing. Not only do such contaminants provide an unsightly appearance, but the same can lead to damage of the decorative unit and/or the house facing, ultimately causing consequential water damage to the structure components. Most damage occurs at doors or windows where water enters and such damage may not be noticed for years. Caulk and adhesives also cannot be applied to wet or frozen surfaces and many times is omitted. Efforts to close such gaps by the use of caulk or other sealant about the border of the decorative unit routinely fail due to the exterior elements and the expansion and contraction effects caused by temperature changes between the decorative unit and the house facing. Also, such application of caulk or other sealant after the decorative unit is secured to the facing is time consuming and costly, and provides an unsightly appearance.

It is an object of the present invention to provide a molded exterior decorative unit for securement to a structural facing that, upon securement to the facing, will provide a flexible seal between the decorative unit and the facing, closing the area between the back surface of the decorative unit and the facing.

SUMMARY OF THE INVENTION

A molded exterior decorative unit for securement to a structural facing, such as a house facing, is formed as a plastic molded unit having a front and rear surface and side edges. The front surface has decorative features thereon, while the rear surface is adapted to be secured adjacent to or abut against the house facing. The rear surface has a channel formed about the molded unit that is adjacent to, but spaced from, the side edges, and a compressible, expandable, flexible sealing member is disposed partially in the channel. The compressible, expandable sealing member is secured in the channel and extends outwardly from the rear surface of the molded unit, such that upon securement of the molded decorative unit to the facing, the sealing member is expanded or compressed to form a flexible seal between the molded decorative unit and the facing.

The channel and the partially contained compressible, expandable, flexible sealing member may extend completely about the periphery of the rear surface of the molded decorative unit, or one or more slots, or weep holes, may be provided to permit escape of moisture from the area between the rear surface of the molded decorative unit and the structural facing.

In another embodiment of the molded exterior decorative unit of the present invention, where the unit is adapted for securement within a recess formed in a structural facing, the channel is formed in the side edge of the unit adjacent to, but spaced from the first surface of the unit. The molded exterior decorative unit is inserted into the recess in the structural facing, with the compressible, expandable, flexible sealing member forming a flexible seal between the molded unit and the surrounding wall of the recess of the structural facing.

In a preferred embodiment, the channel formed in the second surface of the molded unit is in the nature of a countersink, where the channel is shaped so as to form a floor and two side walls therein, and a groove is formed in the central portion of the floor. A pair of ridges maybe provided in the channel, one adjacent each side of the groove.

DESCRIPTION OF THE DRAWINGS

The invention will be more readily understood by reference to the embodiments shown, by way of example only, in the drawings, wherein.

DETAILED DESCRIPTION

Figure 1:
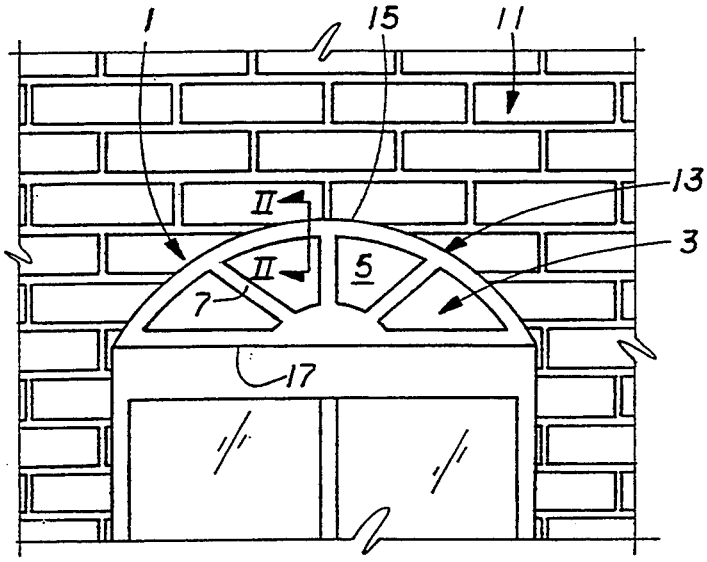
FIG. 1 is a front elevational view of a molded decorative unit of the present invention, in the form of a window head secured to a brick facing above a window.
Figure 2:
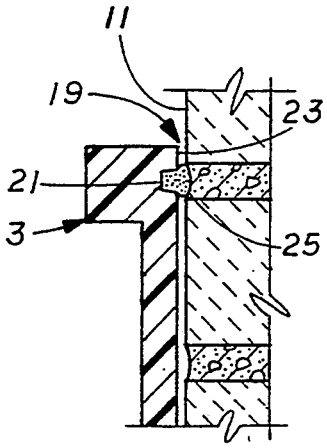
FIG. 2 is a sectional view taken along the lines II—II of FIG. 1 showing compression of a compressible, expandable, flexible sealing member between the molded decorative unit and the brick facing.
Figure 3:
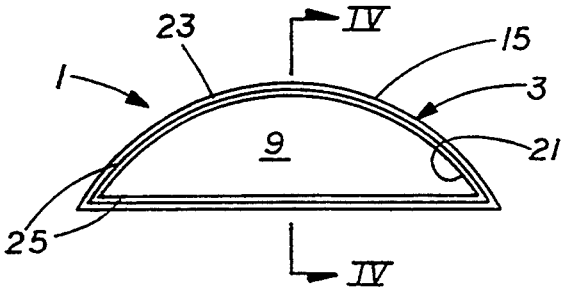
FIG. 3 is an elevational view of the rear surface of the molded decorative unit of FIG. 1.
Figure 4:
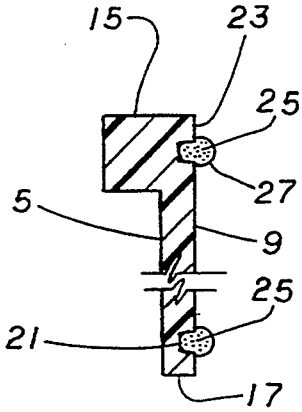
FIG. 4 is a sectional view taken along the lines IV—IV of FIG. 3.

An embodiment of the present molded exterior decorative unit 1 is illustrated in FIGS. 1–4 in the form of a window head. The window head comprises a molded unit 3 having a front or first surface 5 which has decorative features 7 thereon, shown as a raised design, the first surface 5 being adapted for exposure to the environment and to the view of an observer. The back or second surface 9 of the molded exterior decorative unit 1 is adapted for securement adjacent to or abutting a structural facing, such as a brick facing 11 of a structure, such as a house. A side edge 13 connects the two surfaces 5 and 9 about the periphery of the molded exterior decorative unit 1, shown as a top arcuate surface 15 and straight bottom surface 17. As seen in FIG. 2, a structural facing 11, illustrated as a brick facing, will provide an uneven surface and abutment of the back or second surface 9 of the molded unit 3, which is typically a flat surface, will leave gaps or openings 19 between the second surface 9 and the facing 11.

Figure 5:
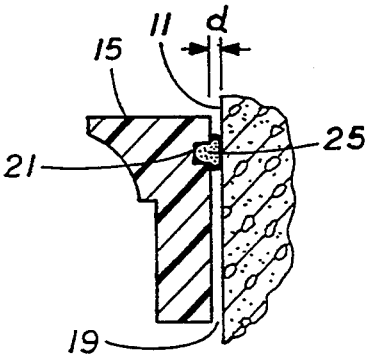
FIG. 5 is an expanded sectional view showing compression of a compressible, expandable flexible sealing member between a molded unit and a facing.
Figure 6:
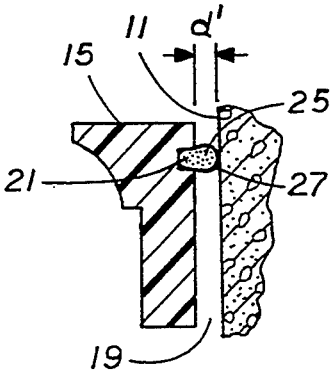
FIG. 6 is a view similar to FIG. 5 showing sealing by the compressible, expandable, flexible sealing member where a larger gap exists between the molded unit and the facing.
Figure 7:
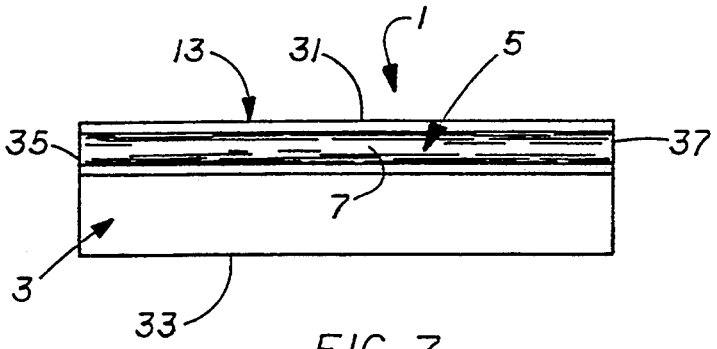
FIG. 7 is a front elevational view of another embodiment of a molded decorative unit of the present invention, in the form of a section of trim.
Figure 9:
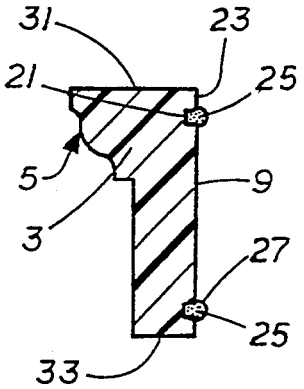
FIG. 9 is a sectional view of the section of trim taken along lines IX—IX of FIG. 8.

In order to seal such gaps or openings 19, the second surface 9 of the molded exterior decorative unit 1 has a channel 21 formed therein, while molding of the molded unit 3, the channel 21 being adjacent to, but spaced from the side edge 13 of the molded exterior decorative unit 1, leaving a border 23 therebetween. Disposed securely in the channel 21 there is provided a compressible, expandable, flexible sealing member 25, preferably in the form of a rod or bar-like shape, the sealing member 25 only partially disposed in the channel 21 such that a portion 27 thereof extends outwardly from the second surface 9. The compressible, expandable, flexible sealing member is preferably secured in said channel by a friction fit therebetween, although adhesive may be applied if desired. With a friction fit, replacement of the compressible, expandable, flexible sealing member, if ever required, is easily achieved. Preferably, greater than fifty percent, or a major portion of the compressible, expandable, flexible sealing member is exposed as portion 27. The molded exterior decorative unit is provided such that upon securement of said molded unit 3 to the facing 11, the compressible, expandable, flexible sealing member 25 is compressed, as illustrated in FIG. 5, to seal the gap 19, of a width d, between the second surface 9 of the molded exterior decorative unit 1 and the facing 11. The compressible, expandable, flexible sealing member 25 is of a material that will remain flexible and will compress or expand if the gap 19 should decrease or increase in size, for whatever reason, so as to retain a seal. In FIG. 6, as compared to FIG. 5, for example, the gap 19 is of a width $d^1$ which is greater than the width d of FIG. 5, but a seal is still maintained by contact of the compressible, expandable, flexible sealing member 25. With provision of the compressible, expandable, flexible sealing member 25, a standardized size of sealing member can be used for a variety of facings that have different sized ridges and valleys therein. Examples of the type of compressible, expandable, flexible material that may be used as the sealing member 25 are an open and closed cell foam backer rod sold under the trademark SOF ®ROD by Applied Extrusions Technologies, Inc. and a foam tape sold under the mark WILLSEAL by Illbruck, Inc., or under the mark EMSEAL by Emseal Corporation.

The SOF ®ROD material is especially useful because, with both open and closed cells, the material is compressible and also will expand, following compressibility, to form an excellent seal. The material, formed from an extruded polyolefin foam, has excellent compatibility, a low water absorption property and, has good compression recovery, or expansion, to provide an excellent seal.

Another especially useful material is a flexible, compressible strip of sodium bentonite such as that sold under the mark WATERSTOP-RX ® by American Colloid Company. Such a sodium bentonite material swells or expands upon hydration and forms a permanent gel impenetrable to air or water. Upon swelling, by water contact, this material forms a gel that will expand to fill the channel and any uneven surface on an adjacent structure, such as a brick facing.

With the channel 21 molded into the second or back surface 9 of the molded unit 3, the compressible, expandable, flexible sealing member 25 is spaced from the side edge 13 by border 23, such that the compressible, expandable, flexible sealing member, while providing a seal between the second surface 9 and the facing 11 will be hidden from view to an observer of the secured molded exterior decorative unit 1. The molded exterior decorative unit 1 is easily installed, as are conventional polyurethane molded trims, by use of nails through the decorative unit into the structural facing and, with the compressibility of the compressible, expandable, flexible sealing member, eliminates the need for workers to apply caulk about the periphery of the unit. Since the channel 21 is formed in the second surface 9 of the molded unit 3 during molding of the same, no machining or chamfering of the molded unit is required.

With the molded exterior decorative unit 1 secured to a facing 11, an insulating air space is provided within the confines of the area enclosed by the compressible, expandable, flexible sealing member, which enables a decorative trim piece to serve an energy efficient function.

Figure 8:
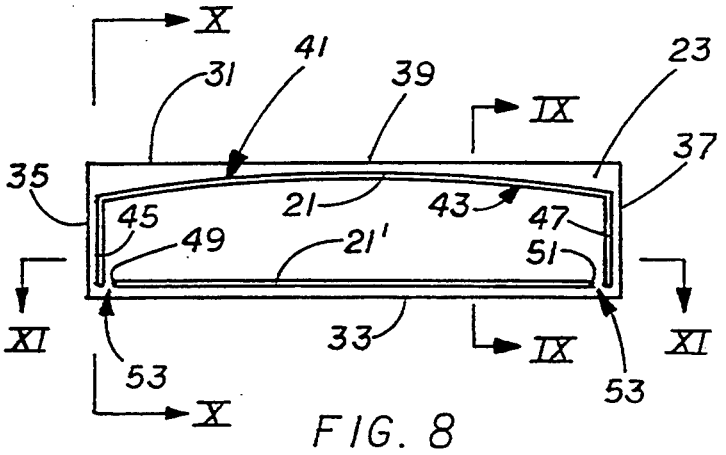
FIG. 8 is a rear elevational view of the section of trim shown in FIG. 7, showing slots, used as weep holes for moisture.
Figure 10:
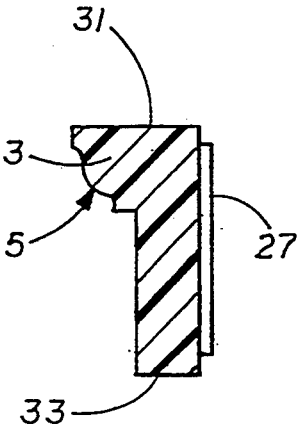
FIG. 10 is a sectional view of the section of trim taken along lines X—X of FIG. 8.
Figure 11:
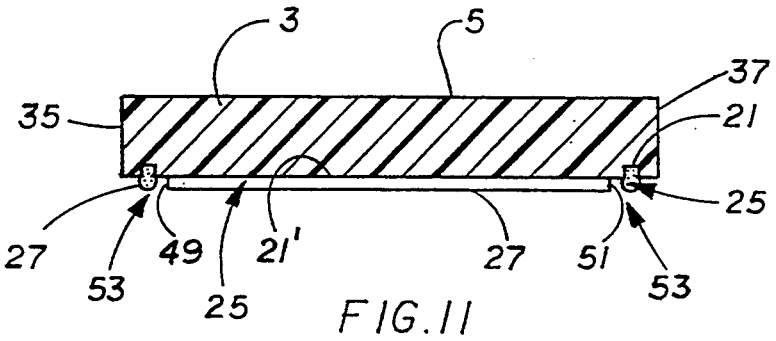
FIG. 11 is a sectional view of the section of trim taken along lines XI—XI of FIG. 8.

Another embodiment of the molded exterior decorative unit of the present invention is illustrated in FIGS. 7–11, wherein the molded exterior decorative unit 1 is shown in the form of a trim for a structure. The molded exterior decorative unit 1 has a first surface 5, or front surface, with a decorative feature such as a sculptured surface 7, and a second surface 9, or back surface, with the side edge 13 in the form of top surface 31, a bottom surface 33, and opposed side surfaces 35 and 37. A channel 21 is formed in second or back surface 9, adjacent to but spaced from the side edge 13 leaving a border 23. In this embodiment, the channel 21 most closely approaches the top surface 31 at the midpoint 39 and extends outwardly from midpoint 39 in a slight downward direction along a first section 41 and 43, on either side of the midpoint 39 until approaching the side surfaces 35 and 37, and then a second section 45 and 47 depends downwardly in a direction approaching a parallel relationship to the side surface, 35 and 37, respectively and terminating at a location spaced from bottom surface 33. Also, as illustrated in FIG. 8, a further channel section 21[1] formed adjacent the bottom surface 33 of the molded unit 3 extends outwardly on both sides from the midpoint 39 of the molded unit 3 but terminates at 49, 51, closely spaced from the second sections 45 and 47 of the upper channel 21 so as to provide slots 53 therebetween which serve as weep holes.

In this embodiment, where the channel 21 most closely approaches the top surface 31 at the midpoint 39, water flowing down the facing 11 from above the secured molded exterior decorative unit 1 will run along the exposed top edge of the compressible, expandable, flexible sealing member 25 and not collect. In addition, the slots 53 will permit escape of interstitial water caused by poor insulating of the facing 11. If desired, channel 21' may also be slightly sloped downwardly from the midpoint 39 towards the ends 49, 51 thereof.

In forming of the molded exterior decorative unit 1, a polymeric material, such as polyurethane, is molded in a mold that forms the decorative features 7 on the first surface 5 and the channel 21 in the second surface 9. A compressible, expandable, flexible sealing member 25 is then secured in the channel 21, with a portion 27 hereof extending outwardly from the second surface 9, which compressible, expandable, flexible sealing member 25 may be secured at a central manufacturing facility or at a job site.

Figure 12:
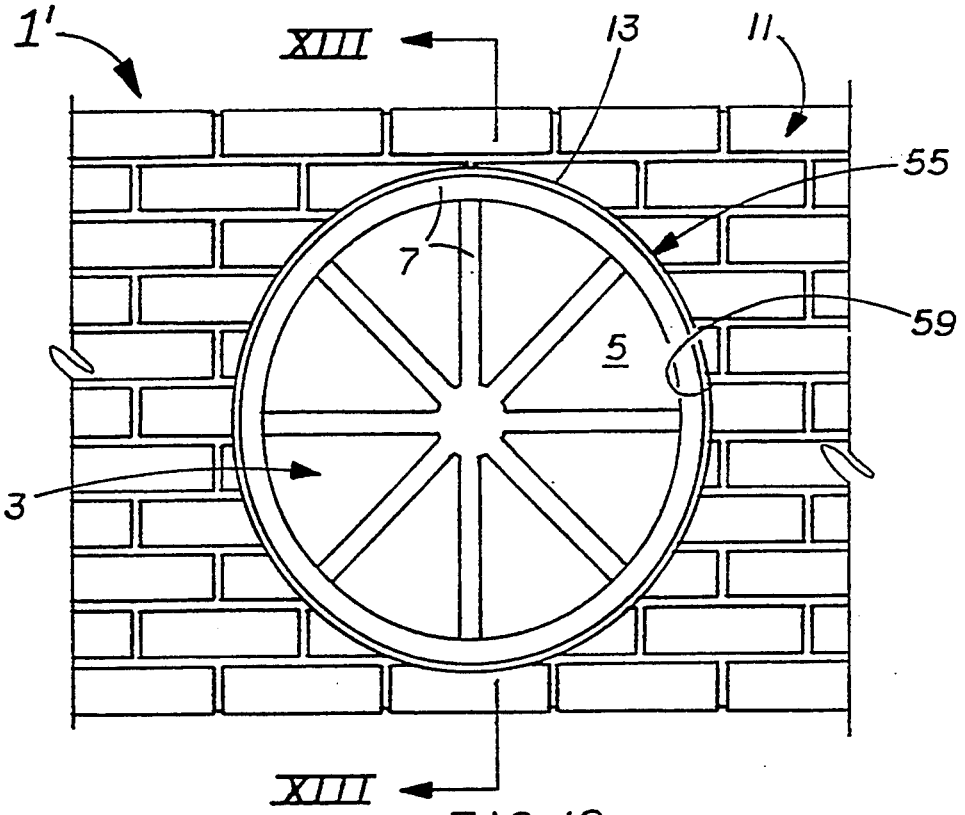
FIG. 12 is a front elevational view of another embodiment of a molded decorative unit of the present invention inserted into a recess formed in a structural facing.
Figure 13:
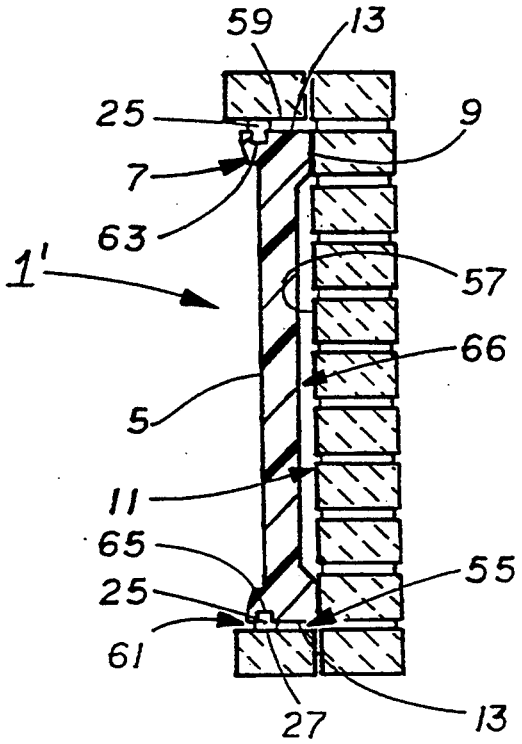
FIG. 13 is a sectional view taken along lines XIII—XIII of FIG. 12.

In another embodiment of the molded exterior decorative unit of the present invention, the unit is adapted for placement within a recess formed in a structural facing. As illustrated in FIGS. 12 and 13, a molded unit exterior decorative unit 1' has a front or first surface 5 with decorative features 7 thereon, the first surface adapted for exposure to the environment. The second or back surface 9 is adapted for positioning adjacent to, or in abutment with, a structural facing 11 of a structure. In this embodiment, the molded exterior decorative unit is adapted to be secured within a recess 55 formed in the structural facing 11, providing a floor 57 and surrounding wall 59 in the facing 11. With placement in such a recess 55, a gap 61 will be formed between the side edge 13 of the molded unit 3 and the surrounding wall 59 in the structural facing 11 when the molded unit is secured with the second surface 9 in abutment with the floor 57 of the recess 55.

In order to seal the gap 61, a channel 63 is formed in the side edge 13 of the molded unit 3 adjacent to, but spaced from, the first surface 5, leaving a border 65 therebetween. Disposed in the channel 63 is a compressible, expandable, flexible sealing member 25, the sealing member 25 only partially disposed in the channel 63 such that a portion 27 thereof extends outwardly from the side edge 13. Upon securement within the recess 55, the compressible, expandable, flexible sealing member is compressed, as shown in FIG. 13, to seal the gap 61 between the side surface 13 of the molded exterior decorative unit 1' and the surrounding wall 59 of the recess 55.

Securement of the molded exterior decorative unit 1' in the recess 55 may be effected by conventional means using nails or adhesives, or the unit 1' may be secured in the recess 55 solely, or in addition to conventional securement, by the frictional engagement resulting from expansion and contraction of the compressible, expandable, flexible sealing member 25 with the wall 59 of the recess 55 formed in the structural facing 11.

A cavity 66 may be provided in the rear surface 9 such that an insulating air chamber is provided which assists in moisture buildup between the molded unit 3 and the brick facing 11. Such a cavity 66 aids in avoiding a moisture buildup, and may be provided in any of the embodiments described herein.

In forming of the molded exterior decorative unit 1' a polymeric material, such as polyurethane, is molded in a mold that forms the decorative features 7 on the first surface 5, a cavity 66 in surface 9, and the channel 63 in the side edge 13. A compressible, expandable, flexible sealing member 25 is then secured in the channel 63, with a portion 27 thereof extending outwardly from the side edge 13, which compressible, expandable, flexible sealing member 25 may be secured at a central manufacturing facility or at a job site.

Figure 14:
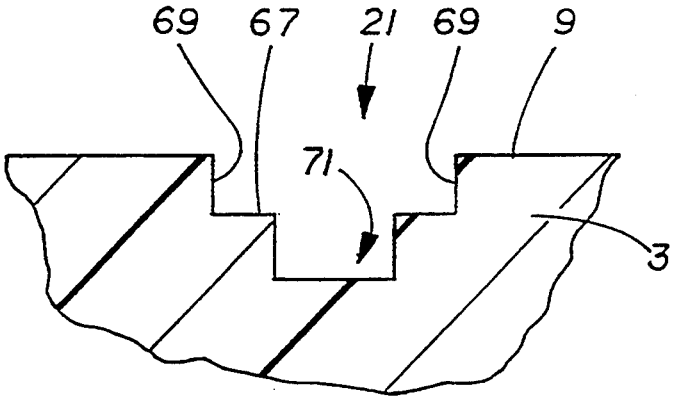
FIG. 14 is a cross-sectional view of a preferred shape of channel formed in the second surface or side edge of the molded decorative unit.
Figure 15:
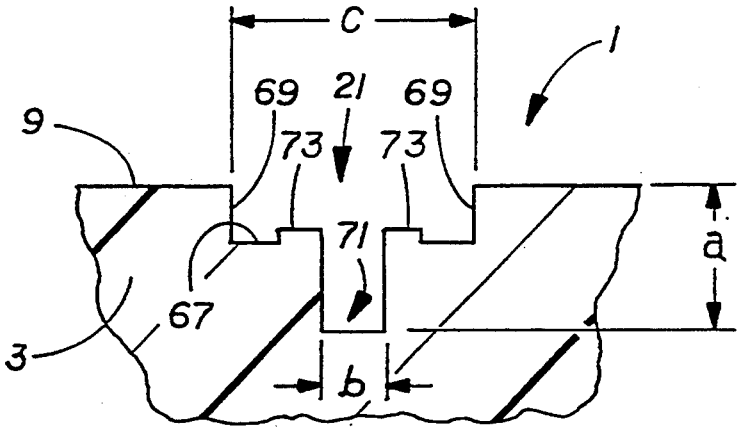
FIG. 15 is a cross-sectional view of another preferred shape of channel formed in the second surface or side edge of the molded decorative unit.
Figure 16:
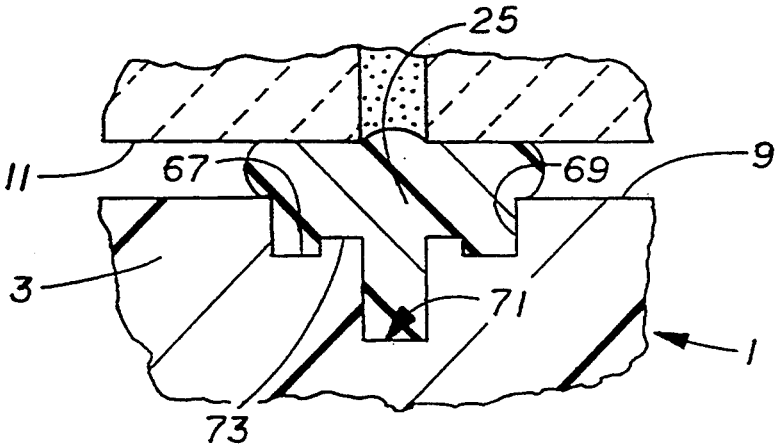
FIG. 16 is a view similar to FIG. 15 showing the compressible, expandable, flexible sealing member disposed in the groove and contacting a brick facing.

In a more preferred embodiment of the present invention, as illustrated in FIGS. 14–16, the channel 21 formed in the second surface 9 or the side edge 13 of the molded decorative unit 1 is formed in the nature of a countersink. Referring to FIG. 14, the channel 21 is shaped so as to form a floor 67 and two side walls 69 in the molded unit 1, and a groove 71 is formed in the central portion of the floor 67. With this arrangement of the channel 21, the compressible, expandable, flexible sealing member, in compressed state, is affixed in the groove 21, and upon expansion or compression recovery the compressible, expandable, flexible sealing member will expand and contact an adjacent structure, with excess compressible, expandable, flexible sealing member spilling outwardly onto the floor 67 and sidewall 69 region of the channel 21. The channel 21 may, if desired, be provided with a radial-shaped bottom and corner and tapered sides to assist in casting and molding thereof.

The most preferred embodiment of the invention, shown in FIGS. 15 and 16, shows the channel 21 formed in the second surface 9 of the molded decorative unit 1, having, as shown in FIG. 14, a groove 71 formed in the central portion of the floor 67 of channel 21, between sidewalls 69 of the channel. In this arrangement of the channel 21, however, a pair of upwardly extending ridges 73 are provided within the channel 21, one adjacent each side of the groove 71. Expansion or compression recovery of a compressible, expandable, flexible sealing member 25 which was originally inserted into the groove 71 is shown in FIG. 16, wherein the member has expanded or recovered from compression to contact a brick facing 11, while excess compressible, expandable, flexible sealing member fills channel 21 and encloses the ridges 73. As illustrated, the depth of the groove 71 is of a value a, while the width of the groove 71 is about ½ of the value a, and the width of the channel 21 is about 1½ times of the value a.

In the embodiment shown in FIG. 14–16, and especially 15 and 16, the arrangement of the channel 21 with the groove 71, and upwardly ridges 73, in conjunction with the compressible, expandable, flexible sealing member 25, creates a labyrinth path for either air or water to prevent passages thereof between the compressible, expandable, flexible sealing member 25 and the molded decorative unit 1.

What is claimed is:

1. A molded exterior decorative unit secured within a recess formed in a structural facing, comprising:

a molded unit having first and second surfaces and a side edge about the periphery thereof connecting said first and second surfaces, said first surface having decorative features thereon for exposure to the environment with said second surface adjacent the structural facing;

said molded unit having a channel formed in said side edge adjacent to, but spaced from, said first surface; and a compressible, expandable, flexible sealing member disposed partially in said channel and extending outwardly from said side edge, such that upon securement of said molded unit to said structural facing, said compressible, expandable, flexible sealing member forms a flexible seal between said molded unit and said structural facing.

2. A molded exterior decorative unit as defined in claim 1 wherein said channel is of a depth such that a major portion of said compressible, expandable, flexible sealing member extends outwardly from said channel when secured in said channel.

3. A molded exterior decorative unit secured to a structural facing, comprising:

a molded unit having first and second surfaces and a side edge about the periphery thereof connecting said first and second surfaces, said first surface having decorative features thereon for exposure to the environment with said second surface secured adjacent a structural facing;

said molded unit having a channel formed in at least one of said second surface and said side edge adjacent to, but spaced from, one of said side edge and said first surface respectively, said channel extending completely about the periphery of said molded unit;

a compressible, expandable, flexible sealing member disposed partially in said channel, completely about the periphery of said molded unit, and extending outwardly from said second surface or side edge, such that upon securement of said molded unit to said structural facing, said compressible, expandable, flexible sealing member forms a flexible seal between said molded unit and said structural facing.

4. A molded exterior decorative unit secured to a structural facing, comprising:

a molded unit having first and second surfaces and a side edge about the periphery thereof connecting said first and second surfaces, said first surface having decorative features thereon for exposure to the environment with said second surface secured adjacent a structural facing;

said molded unit having a channel formed in at least one of said second surface and said side edge adjacent to, but spaced from, one of said side edge and said first surface respectively, said channel shaped so as to form a floor and two side walls in said molded unit, and a groove is formed in a central portion of said floor; and a compressible, expandable, flexible sealing member disposed partially in said channel, secured in said groove, and extending outwardly from said second surface or side edge, such that upon securement of said molded unit to said structural facing, said compressible, expandable, flexible sealing member forms a flexible seal between said molded unit and said structural facing.

5. A molded exterior decorative unit as defined in claim 4 wherein a pair of upwardly extending ridges are provided within said channel, one adjacent each side of said groove.

6. The molded exterior decorative unit as defined in claim 4 wherein said channel is formed in said second surface; said second surface has a cavity therein; said side edge comprises a top surface with a midpoint, a bottom surface and side surfaces, and said channel comprises a first channel section disposed between said second surface recess and the top surface and side surfaces of said side edge extending from either side of the midpoint outwardly and downwardly therefrom; and a further channel section is provided adjacent the bottom surface of said molded unit which extends from said midpoint derminating closely spaced from said first channel section to provide slots therein which communicate with said second surface recess.

7. A molded exterior decorative unit secured to a structural facing, comprising:

a molded unit having first and second surfaces and a side edge about the periphery thereof connecting said first and second surfaces, said side edge comprising a top surface with a midpoint, bottom surface and side surfaces, said first surface having decorative features thereon for exposure to the environment with said second surface secured adjacent the structural facing;

said molded unit having a channel formed in said second surface adjacent to, but spaced from, said side edge, with said channel most closely approaching said top surface adjacent said midpoint thereof and extending in an outwardly and downwardly direction therefrom;

a compressible, expandable, flexible sealing member disposed partially in said channel and extending outwardly from said second surface or side edge, such that upon securement of said molded unit to said structural facing, said compressible, expandable, flexible sealing member forms a flexible seal between said molded unit and said structural facing.

8. A molded exterior decorative unit as defined in claim 7 wherein said channel adjacent said top surface comprises a first channel section on either side of the midpoint until approaching a respective side surface, and wherein a second channel section depends downwardly from said first channel section, said second channel section approaching a parallel relationship to said respective side surface.

9. A molded exterior decorative unit as defined in claim 8 wherein a further channel section is provided adjacent the bottom surface of said molded unit which extends from said midpoint derminating closely spaced from each of said second channel sections to provide slots therebetween.

10. A molded exterior decorative unit as defined in claim 3 wherein said molded unit is of a polyurethane material.

11. A molded exterior decorative unit as defined in claim 3 wherein said compressible, expandable, flexible sealing member is secured in said channel by a friction fit.

12. A molded exterior decorative unit as defined in claim 3 wherein said compressible, expandable, flexible sealing member is a combination closed and open cell foam material.

13. A molded exterior decorative unit as defined in claim 3 wherein said compressible, expandable, flexible sealing member is a strip of sodium bentonite material.

14. A molded exterior decorative unit to a structural facing, comprising:

a molded unit having first and second surfaces and a side edge forming top, bottom and opposed side surfaces about the periphery thereof connecting said first and second surfaces, said first surface having decorative features thereon for exposure to the environment with said second surface secured adjacent a structural facing;

said molded unit having a channel formed in said second surface adjacent to, but spaced from the opposed side surface of the side edge, said channel most closely approaching the top surface adjacent a midpoint of said top surface and extending in an outward and downward direction therefrom; and a compressible, expandable, flexible sealing member disposed partially in said channel and extending outwardly from said second surface, such that upon securement of said molded unit to said structural facing, said compressible, expandable, flexible sealing member forms a flexible seal between said molded unit and said structural facing.

15. A molded exterior decorative unit as defined in claim 14 wherein said channel adjacent said top surface comprises a first channel section on either side of the midpoint until approaching a respective side surface, and wherein a second channel section depends downwardly from said first channel section, said second channel section approaching a parallel relationship to said respective side surface, and a further channel section is provided adjacent the bottom surface of said molded unit which extends from said midpoint, and extends outwardly therefrom, derminating closely spaced from each of said second channel section to provide slots therebetween.

16. A molded exterior decorative unit as defined in claim 14 wherein said molded unit is of a polyurethane material.

17. A molded exterior decorative unit as defined in claim 14 wherein said channel is shaped so as to form a floor and two side walls in said molded unit, and a groove is formed in a central portion of said floor.

18. A molded exterior decorative unit as defined in claim 17 wherein a pair of upwardly extending ridges are provided within said channel, one adjacent each side of said groove.

19. A molded exterior decorative unit as defined in claim 14 wherein said compressible, expandable, flexible sealing member is a strip of sodium bentonite material.

20. A molded exterior decorative unit be secured within a recess in a structural facing, and secured to said structural facing comprising:

a molded unit having first and second surfaces and a side edge about the periphery thereof connecting said first and second surfaces, said first surface having decorative features thereon for exposure to the environment with said second surface secured adjacent a floor of said structural facing within said recess and with said side edge spaced from a surrounding wall of said recess;

said molded unit having a channel formed in said side edge adjacent to, but spaced from, said first surface;

a compressible, expandable, flexible sealing member disposed partially in said channel and extending outwardly from said side edge, such that upon securement of the second surface of said molded unit adjacent the floor of said recess of said structural facing, said compressible, expandable, flexible sealing member forms a flexible seal between said molded unit and the surrounding wall of said recess of said structural facing.

21. The molded exterior decorative unit as defined in claim 20 wherein said molded unit is secured in said recess by contact of said compressible, expandable, flexible sealing member with the surrounding wall of the recess of said structural facing.

22. The molded exterior decorative unit as defined in claim 21 wherein said compressible, expandable, flexible sealing member is a strip of sodium bentonite material.

23. A molded exterior decorative unit secured to a structural facing comprising:

a molded unit having first and second surfaces and a side edge forming top, bottom and opposed side surfaces about the periphery thereof connecting said first and second surfaces, said first surface having decorative features therein for exposure to the environment with said second surface secured adjacent a structural facing;

said molded unit having a channel formed in said second surface adjacent to, but spaced from said top surface, said channel most closely approaching said top surface adjacent a midpoint thereof and extending in an outward and downward direction therefrom, said channel having a first channel section adjacent said top surface and a second channel section depending downwardly from said first channel section approaching a parallel relationship to said opposed side surfaces; and a further channel section adjacent said bottom surface extending from both sides of said midpoint terminating in a closely spaced relationship to said second channel section to provide a slot therebetween; and a compressible, expandable, flexible sealing member disposed partially in said first and second channel sections and said further channel, and extending outwardly from said second surface, such that upon securement of said molded unit to said structural facing, said compressible, expandable, flexible sealing member forms a flexible seal between said molded unit and said structural facing.

24. A molded exterior decorative unit as defined in claim 23 wherein said molded unit is of a polyurethane material and said compressible, expandable, flexible sealing member is a combination closed and open cell foam material.

25. A molded exterior decorative unit as defined in claim 23 wherein said compressible, expandable, flexible sealing member is a strip of sodium bentonite material.

* * * * *